United States Patent [19]

Atkinson

[11] 4,318,808

[45] Mar. 9, 1982

[54] INSPECTION DEVICE FOR CONTAINERS

[75] Inventor: David A. Atkinson, Parkersburg, W. Va.

[73] Assignee: Ball Corporation, Muncie, Ind.

[21] Appl. No.: 45,380

[22] Filed: Jun. 4, 1979

[51] Int. Cl.[3] ..... B07C 5/00

[52] U.S. Cl. ..... 209/533; 209/602; 209/605; 33/174 PC

[58] Field of Search ..... 209/530, 531, 533, 600, 209/601, 602, 604, 594, 523, 605; 33/174 PC; 250/229

[56] References Cited

U.S. PATENT DOCUMENTS

| | | | |
|---|---|---|---|
| 2,937,749 | 5/1960 | Strzala | 209/531 |
| 3,410,402 | 11/1968 | Gundrum et al. | 209/533 |
| 3,417,476 | 12/1968 | Martens | 209/604 X |
| 3,767,044 | 10/1973 | Harben et al. | 209/594 |
| 3,901,797 | 8/1975 | Storace et al. | 209/594 |
| 4,118,871 | 10/1978 | Kirkham | 33/174 PC |
| 4,121,716 | 10/1978 | Luperti et al. | 209/604 X |

FOREIGN PATENT DOCUMENTS

| | | | |
|---|---|---|---|
| 369369 | 3/1932 | United Kingdom | 209/594 |

*Primary Examiner*—Joseph J. Rolla

*Attorney, Agent, or Firm*—Nicholas T. Bokides

[57] ABSTRACT

The present invention relates to inspection devices for containers such as glass bottles. In prior art inspection devices, it has been a problem to automatically inspect bottles with concave side panels for sunken or bulged panels. The present invention provides an inspection device (10) that includes an optical gauging device (24) for automatically gauging the side panels of a container (74); and a digital signal actuates an ejector actuator (54) for ejecting defective bottles from a conveyor (12). The optical gauging device (26) includes a light beam detector (28), and a transducer (30) that is optically interposed between a light source (48) and a photoelectric sensor (50) of the light beam detector (28). The transducer (30) is connected to a mechanical contactor (32) that is actuated into contact with a concave side panel either with or without stopping movement of the conveyor. Principle uses include inspection of flat and concave side panels of glass bottles and other containers.

4 Claims, 9 Drawing Figures

INSPECTION DEVICE FOR CONTAINERS

TECHNICAL FIELD

The present invention relates to inspection devices for use in conjunction with articles moving along a conveyor line, and more particularly to inspection devices for containers such as glass bottles.

BACKGROUND ART

Inspection devices of the prior art, whether for use in inspecting containers such as glass bottles or whether for inspecting other types of articles, have been of four basic types.

In a first type of inspection device for use in inspecting articles being moved by a conveyor line, electrical switches of the mechanically actuated type have been used to signal the presence of out-of-tolerance articles. An early device of this type is taught by Wagner in U.S. Pat. No. 1,758,268 in which mechanically actuated reed switches are used for the measuring and sorting of cores such as those which are used in the construction of relays and magnets. The use of mechanically actuated electrical switches in inspection devices is also taught by Fry et al. in U.S. Pat. No. 3,076,268 and by Wolford, U.S. Pat. No. 3,080,659, both of which pertain to inspection devices for bottles or containers.

In a second type of prior art device, Roberson, in U.S. Pat. No. 3,537,579, shows and describes a container gauging and sorting apparatus in which the progression of containers or bottles along a conveyor line is stopped by oversized containers which will not pass between a pair of fixed plates. Stoppage of Roberson's conveyor line is effective to signal the reject mechanism and to eject the out-of-tolerance container.

In a third type of prior art inspection device, Stein, in U.S. Pat. No. 3,814,241, teaches the use of a transducer, which includes an armature and coil, for providing a signal to indicate out-of-tolerance containers.

In the fourth type of prior art construction, as taught by DeTar in U.S. Pat. No. 2,504,505, and by Luhn et al., in U.S. Pat. No. 3,031,075, photoelectric sensors are used to provide an out-of-tolerance signal for articles being measured.

The present invention utilizes an optical gauging device that includes a photoelectric sensor and a transducer for varying the quantity of light that reaches the photoelectric cell in accordance with minimum and maximum size limitations for the container or bottle.

The transducer is simple and durable, eliminating the complexity of previous photoelectric sensor inspection devices and also eliminating failure problems that are associated with mechanically actuated electrical switches.

DISCLOSURE OF INVENTION

In accordance with the broader aspects of this invention, there is provided an inspection device for detecting containers that are outside of minimum or maximum size limitations. The inspection device includes a mechanical reference for contacting a container or glass bottle at a first location, and a mechanical contactor for contacting the container or bottle at a second location. A transducer is connected to the mechanical contactor and is optically interposed between a light source and a photoelectric sensor; and variations of light transmitted from the light source to the photoelectric sensor are accomplished, in accordance with minimum and maximum size limitations of the container, by the transducer.

The transducer includes a first member having an aperture therethrough and a second member having an aperture therethrough. One of the members is operatively connected to the mechanical contactor; so that variations in optical overlapping of the apertures, and resultant variations in the transmission of light, are indicative of size variations in the containers being inspected.

The inspection device also includes a contact actuator for actuating the mechanical contactor into contact with a container and for retracting the mechanical contactor away from the container. This feature is necessary for inspecting containers that are designed with a concave side panel.

A contact detector is provided for determining when the mechanical contactor is in contact with the side panel of a container.

A digital logic system is connected to both the photoelectric sensor and to the contact detector and is effective to provide a reject signal that is a function of the output of the photoelectric sensor at the time when the contact sensor indicates that the mechanical contactor is in contact with a container.

When used with a conveyor, the present invention includes a container position detector for controlling a second signal that indicates the position of one container and subsequent containers relative to the photoelectric sensor and the transducer.

Also, an ejector actuator is provided; and a digital memory device is provided for retaining the reject signal and for applying the reject signal to the ejector actuator at the time that a rejected container has been conveyed to the location of the ejector actuator.

The advantages of the present invention include providing an automatic inspection device for inspecting flat or concave side panels of bottles for sunken or bulged panels, elimination of the necessity of stopping the conveyor during inspection, automatic ejection of rejected containers, automatic extension and retraction of the mechanical contactor that gauges the container, simplicity and durability of the optical gauging device and of the transducer which forms a part thereof, utilization of solid-state digital logic, and ease of setup.

The abovementioned and other advantages of the present invention and the manner of attaining them will become more apparent and the invention itself will be best understood by reference to the following description of an embodiment of the invention taken in conjunction with the accompanying drawings.

BEST MODE FOR CARRYNG OUT THE INVENTION

Figure 2:
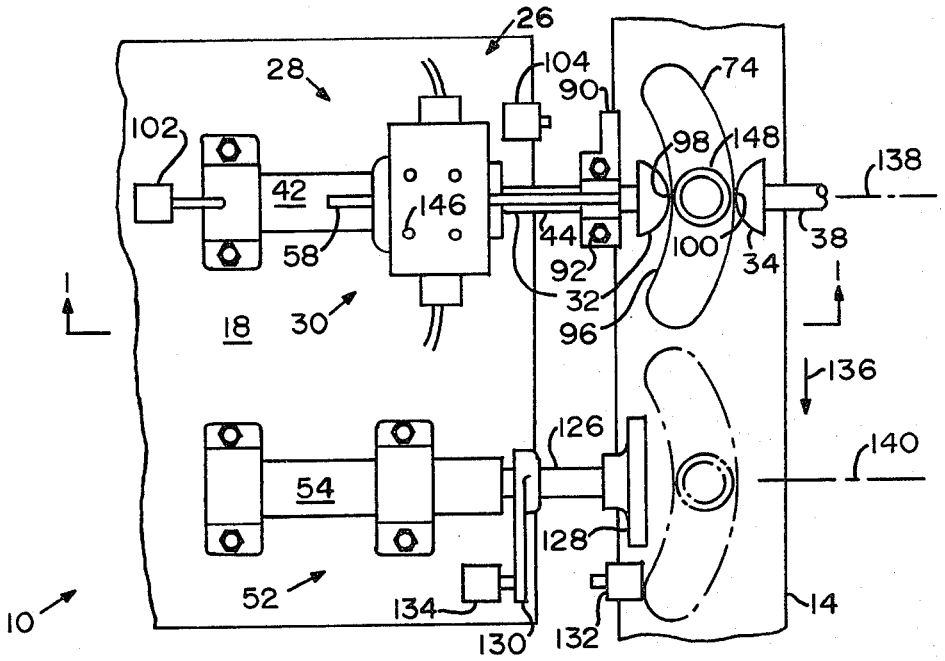
FIG. 2 is a top view of the present invention taken substantially as shown by view line 2—2 of FIG. 1.
Figure 1:
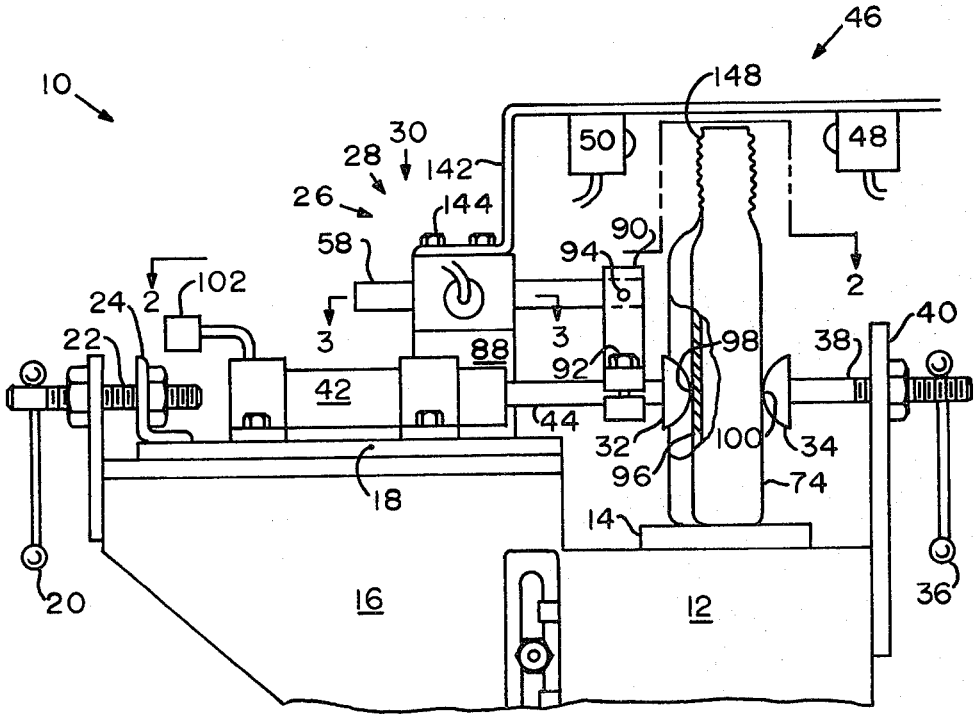
FIG. 1 is a front elevation of the present invention taken substantially as shown by view line 1—1 of FIG. 2.

Referring now to the drawings, and more particularly to FIGS. 1 and 2, an inspection device 10 includes a conveyor 12 having a conveyor belt 14, an inspection knee 16 that is attached to the conveyor 12 and that is adjustable vertically in relation thereto, and an inspection slide base 18 that is transversely adjustable by a handle 20 and by a screw 22 that threadably engages an angle plate 24.

The inspection device 10 further includes an optical gauging device 26 that includes both a light beam detector 28 and a transducer 30, a mechanical contactor 32, a mechanical reference 34 that is transversely adjustable by a handle 36 and by a screw 38 that threadably engages a plate 40, a contact actuator 42 that preferably comprises a fluid motor or cylinder having a piston rod 44, a container position detector 46 that comprises a light source 48 and a photoelectric sensor 50, and ejector means 52 that comprises an ejector actuator or cylinder 54.

Referring now to FIGS. 3-6, FIG. 3 shows a cross-sectional view of the optical gauging device 26, taken substantially as shown by section line 3—3 of FIG. 1. The transducer 30 includes a transducer body or first member 56, and a second member or slide 58 which is an elongated element with flat and substantially spaced-apart surfaces 59*a* and 59*b*; and the light beam detector 28 includes a light source 60 and a photoelectric sensor 62. The transducer body 56 includes a slot 64 that slidably receives the second member 58, a first bore 66 that is transversely disposed to and that intercepts the slot 64, a second bore 68 that is substantially coaxial to the first bore 66 and that stops short of intercepting the slot 64, and a first aperture 70 that intercepts both the second bore 68 and the slot 64 and that serves as a first light transmitting portion.

The second member or slide 58 includes a second aperture or light transmitting portion 72 that optically overlaps the first light transmitting portion 70 when a container or glass bottle 74 of FIGS. 1 and 2 is within both minimum and maximum size limitations. Thus a width 76 of the first light transmitting portion 70 plus a width 78 of the second light transmitting portion 72 is made to substantially equal the difference between the minimum and maximum size limitations of the container 74. Therefore, when a given container 74 is exactly between the minimum and maximum size limitations, a maximum quantity of light will be transmitted from the light source 60 to the photoelectric sensor 62; and, as a given container 74 approaches either the minimum or maximum size limitations, the quantity of light that is transmitted to the photoelectric sensor 62 is decreased to substantially zero.

Figure 6:
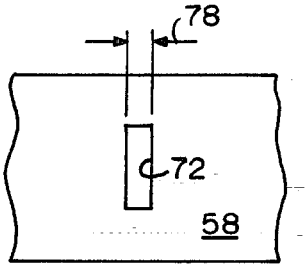
FIG. 6 is a front elevation of one member of the transducer of FIG. 4, taken substantially as shown in FIG. 4.
Figure 7:
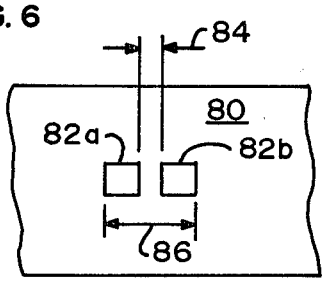
FIG. 7 is a front elevation of an alternate construction for the transducer member of FIG. 6.
Figure 3:
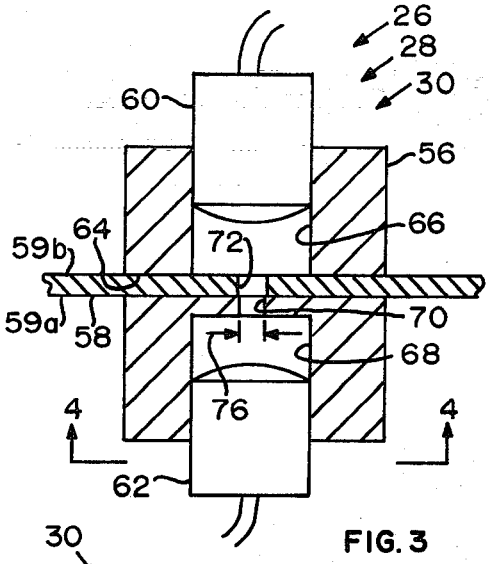
FIG. 3 is a cross-sectional view of the optical gauging device of FIGS. 1 and 2, taken substantially as shown by section line 3—3 of FIG. 1.
Figure 5:
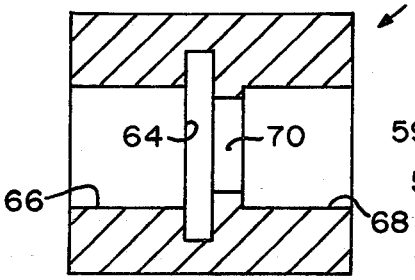
FIG. 5 is a cross-sectional view of the transducer body of FIG. 4, taken substantially as shown by cross-section line 5—5 of FIG. 4.
Figure 4:
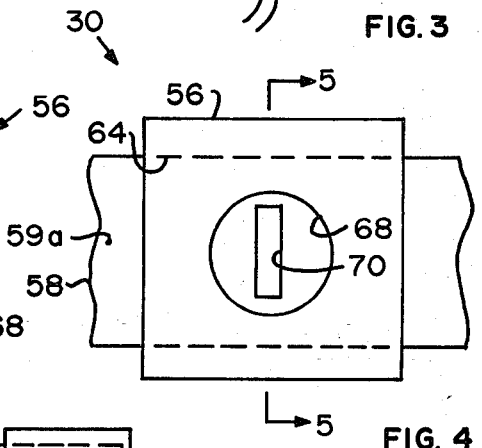
FIG. 4 is a front elevation of the transducer portion of the optical gauging device of FIG. 3, taken substantially as shown by view line 4—4 of FIG. 3.

Referring now to FIGS. 3, 6, and 7, in FIG. 7 an alternate member or alternate slide 80 includes light transmitting portions or apertures 82*a* and 82*b* which are separated by a distance 84 that is substantially equal to the width 76 of the light transmitting portion 70 and which have a total width 86 that is equal to or greater than the sum of the width 76 and the difference between the maximum and minimum size limitations of the container 74. In this alternate design, there is little or no transmission of light from the light source 60 to the photoelectric sensor 62 when a given container 74 is on the nominal dimension; and the transmission of light increases as a given container approaches either the minimum or the maximum size limitation.

Referring again to FIGS. 1 and 2, the piston rod 44 of the contact actuator 42 is coaxial with the screw 38 and the mechanical reference 34; and the mechanical contactor 32 is coaxial to and is attached to the piston rod 44; so that the mechanical contactor 32 and the mechanical reference 34 are coaxial. The transducer 30 is attached to the slide base 18 by a bracket 88; and the transducer 30 is disposed with the second member 58 centered above the piston rod 44 as shown. The piston rod 44 is attached to the second member 58 by an arm 90 that is clamped to the piston rod 44 by bolts 92 and that is attached to the second member 58 by a pin 94. Thus the contact actuator 42 is effective to move the mechanical contactor 32 into contact with a concave side panel 96 of the container 74 at a selected location 98 and to press a selected location 100 of the container 74 into contact with the mechanical reference 34. Also, because of the connection between the piston rod 44 and the second member 58 by the arm 90, the second member 58 is moved to a position that corresponds with the position of the contactor 32 as the contactor 32 is moved into contact with the container 74 to check the size thereof.

A fluid pressure actuated electrical control or pressure actuated switch 102 is attached to the contact actuator 42 and is effective to provide digital control over an electrical signal in accordance with a buildup of fluid or pneumatic pressure in the contact actuator 42 as the mechanical contactor 32 meets the resistance of the container 74. Thus the pressure actuated switch 102 serves as a contact detector means for controlling an electrical signal. In addition, a position actuated electrical control or mechanically actuated switch 104 is provided; and the switch 104 cooperates with the arm 90 to provide a digital electrical signal upon retraction of the piston rod 44.

Figure 8:
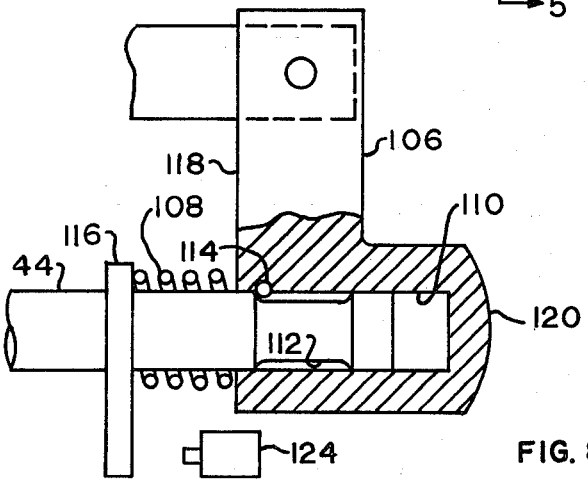
FIG. 8 is a partial and cross-sectional view showing an alternate design for a portion of the inspection device of FIG. 1, taken substantially as shown in FIG. 1.

Referring now to FIG. 8, in an alternate design, an arm 106 is attached to the piston rod 44 by a resilient means or spring 108. The arm 106 includes a bore 110 that slidably receives the piston rod 44 and the piston rod 44 is retained within the bore 110 by a circumferential groove 112 and a transverse pin 114. The spring 108 is disposed between a shoulder 116 that is attached to the piston rod 44 and a face 118 of the arm 106. In this alternate design, a surface 120 serves as the mechanical contactor; and the spring 108 provides a resilient means for allowing the piston rod 44 to extend to a predetermined location regardless of variations in the sizes of given ones of the containers 74.

Predetermined stroking of the contact actuator 42 of FIGS. 1 and 2 is provided by a position actuated electrical control or mechanically actuated switch 124 of FIG. 8 that is engaged by the shoulder 116 as the piston rod 44 extends outwardly. Thus, in the embodiment of FIG.

8, the mechanically actuated switch 124 replaces the pressure actuated switch 102.

Referring again to FIGS. 1 and 2, the ejector means 52, which includes the ejector actuator or cylinder 54, further includes a piston rod 126, an ejector foot 128 that is attached to the piston rod 126, a switch arm 130 that is connected to the piston rod 126, and mechanically actuated switches 132 and 134 that are actuated by the switch arm 130 as the ejector actuator 54 extends and retracts respectively.

The actuators 42 and 54 are preferably pneumatic cylinders of the double action type; and they are preferably actuated by air from a pneumatic source (not shown), by solenoid operated valves (not shown), and by respective ones of the switches 102, 104, 132, and 134, or the switch 124 of FIG. 8 may be used in place of the switch 102 as previously described.

Referring again to FIGS. 1 and 2, the conveyor belt 14 travels in a direction as indicated by an arrow 137 so that the optical gauging device 26 is located at a line or position 138 and the ejector means 52 is located downstream at a line or position 140. Thus if the container 74 is determined to be defective at the position 138, it should be ejected from the conveyor belt 14 at the position 140.

The container position detector 46 of FIG. 1 includes a mounting bracket 142 that is attached to the transducer body 56 by bolts 144 that engage bolt holes 146 of FIG. 2. Thus the light source 48 and the photoelectric sensor 50 are nominally centered on the position 138. However, if desirable, the light source 48 and the photoelectric sensor 50 may be positioned somewhat upstream of the position 138 to provide earlier sensing of a neck 148 of the container 74 and therefore to provide time for the piston rod 44 to extend and for the mechanical contactor 32 to contact the container 74 at the selected location 98.

Figure 9:
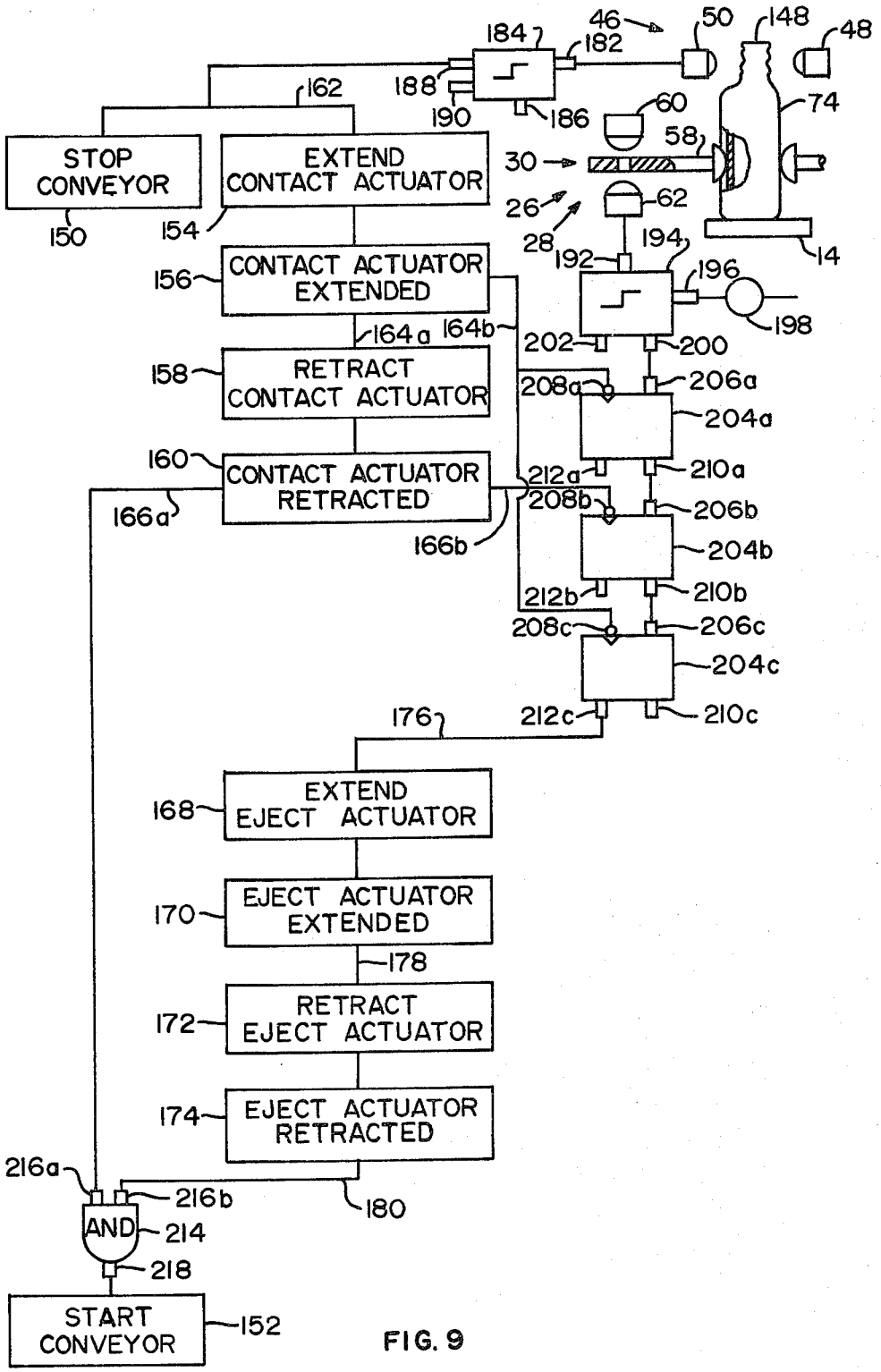
FIG. 9 is a schematic and flow diagram, pictorially illustrating portions of the device of FIGS. 1 and 2, showing a simplified schematic of the digital logic, and showing a flow diagram.

Referring now to FIGS. 1, 2, and 9, and more particularly to FIG. 9, the sequence of operations for the utilization of the inspection device 10 of FIGS. 1 and 2 is indicated by ten function boxes. Function boxes 150 and 152 respectively are for stopping and starting the conveyor 12. Even though the preferred process does not include stopping the conveyor 12 during the inspection process, the stop and start functions are included for completeness.

The FIG. 9 illustration also includes function boxes 154, 156, 158, and 160 which indicate the extending and contracting of the contact actuator 42. If it is assumed that a signal is provided in a conduit 162 and that this signal starts extending the contact actuator 42 of FIGS. 1 and 2, then the function box 154 indicates this extending of the contact actuator 42. When the contact actuator 42 is completely extended, as indicated by the function box 156, a digital signal is provided in conduits **164*a* and 164*b* by either the pressure actuated switch 102 of FIG. 1 or the mechanically actuated switch 124 of FIG. 8. This digital signal in the conduit 164*a* is used to start retracting the contact actuator 42 as indicated by the function box 158; and when the contact actuator 42 is fully retracted, a digital signal is provided in conduits 166*a* and 166*b* that is a result of the arm 90 of FIG. 2 contacting the mechanically actuated switch 104. Thus a signal in a conduit 162 results in extending and retracting the contact actuator 42 and in the production of digital signals in the conduits 164*b*, 166*a*, and 166*b*** as previously described.

Referring again to FIGS. 1, 2, and 9, and more particularly to FIG. 9, the FIG. 9 drawing includes function boxes 168, 170, 172, and 174 which illustrate the extending and retracting of the ejector actuator 54. If it is assumed that there is a signal in a conduit 176 that is effective to start extending the ejector actuator 54, then this extending of the ejector actuator 54 is indicated by the function box 168, the completion of extending of the ejector actuator 54 is indicated by the function box 170, a digital signal is provided in a conduit 178 by the arm 130 of the ejector actuator 54 of FIG. 2 contacting the mechanically actuated switch 132, the retraction of the ejector actuator 54 is started by the digital signal in the conduit 178 and this retraction of ejector actuator 54 is indicated by the function box 172, completion of retracting of the ejector actuator 54 is indicated by the function box 174, and a digital signal is provided in a conduit 180 which indicates that the ejector actuator 54 is fully retracted and which is provided by the arm 130 of FIG. 2 contacting the mechanically actuated switch 134. Thus a digital signal in the conduit 176 results in extending the actuator 54, in retracting the actuator 54, and in providing a digital signal in the conduit 180.

The optical gauging device 26 is pictorially represented in FIG. 9 by showing the light source 60 and the photoelectric sensor 62 of the light beam detector 28 and by showing the second member 58 of the transducer 30 being interposed between the light source 60 and the photoelectric sensor 62.

The container position detector 46 of FIGS. 1 and 2 is also pictorially included in FIG. 9 and shows the neck 148 of the container 74 being intermediate of the light source 48 and the photoelectric sensor 50. The photoelectric sensor 50 is connected to an input terminal 182 of a trigger circuit 184. The trigger circuit 184 may be of the type which is generally known as a Schmitt trigger; and preferably includes a summing amplifier for summing the analog output of the photoelectric sensor 50, as applied to the input terminal 182, and an adjustable bias signal applied to a bias terminal 186. Thus a digital output is supplied to a Q output terminal 188 that is a function of the analog input to the input terminal 182 and any bias voltage that is supplied to the bias terminal 186. The trigger circuit 184 also includes a $\overline{Q}$ output terminal 190 whose output is the digital complement of the digital output at the Q output terminal 188.

Thus it can be seen that the interposition of the neck 148 of the container 74 is effective to decrease the transmission of light from the light source 48 to the photoelectric sensor 50; and this decrease in transmission of light is effective to provide a digital output to the output terminal 188 and to the conduit 162, thereby stopping the conveyor belt 14 and extending the contact actuator 42.

As the contact actuator 42 is extended, there is variation in the transmission of light from the light source 60 to the photoelectric sensor 62 because of interposition of the second member 58 therebetween and because of variations in the optical overlapping of the light transmitting portions 70 and 72 of FIG. 3. The analog voltage output of the photoelectric sensor 62 is applied to an input terminal 192 of a trigger circuit 194; and a bias voltage is applied to a bias terminal 196 by a potentiometer 198 and a voltage source (not shown). The voltages that are applied to the terminals 192 and 196 provide a digital output at a Q output terminal 200 of the trigger circuit 194 as a result of a decrease in the output of the photoelectric sensor 62 and at a voltage magnitude as determined by the bias voltage that is applied to the bias terminal 196; and the complementary digital signal is provided at a $\overline{Q}$ terminal 202.

The schematic illustration of FIG. 9 also includes flip-flop circuits 204*a*, 204*b*, and 204*c* which respectively include input terminals 206*a*, 206*b*, and 206*c*, clock terminals 208*a*, 208*b*, and 208*c*, Q output terminals 210*a*, 210*b*, and 210*c*, and $\overline{Q}$ terminals 212*a*, 212*b*, and 212*c*.

The functioning of the flip-flop circuits 204*a*, 204*b*, and 204*c*, is identical so that a description of one will suffice for all. If a digital signal, which varies between 0 and 1, is applied to the input terminal 206*a*, the same digital signal is supplied to the Q outpt terminal 210*a* at the time that a digital signal is applied to the clock terminal 208*a*. In other words, the value of the digital output signal at the Q output terminal 210*a*, whether 0 or 1, is dependent upon the value of the digital slignal at the input terminal 206*a* at the time of the applying of a digital signal to the clock terminal 208*a*.

Finally, the circuit of FIG. 9 includes an AND gate 214 having input gates 216*a* and 216*b* and having an output terminal 218.

Having described the functioning of the various components in the FIG. 9 illustration, the overall operation is as follows: When the neck 148 of the container 74 decreases the transmission of light from the light source 48 to the photoelectric sensor 50, the resultant decrease in the voltage output of the photoelectric sensor 50 is applied to the input terminal 182 of the trigger circuit 184. This decrease in voltage at the input terminal 182 results in a change in the digital output of the output terminal 188 from 0 to 1 and a change in the digital output of the $\overline{Q}$ output terminal 190 from 1 to 0. This change in the output signal in the Q output terminal 188 is applied, via the conduit 162, both to the function box 150 to stop the conveyor 12 and to the function box 154 to extend the contact actuator 42.

As the contact actuator 42 extends, the transmission of light from the light source 60 to the photoelectric sensor 62 of the light beam detector 28 is varied in accordance with optical overlapping of the light transmitting portions 70 and 72 of the transducer 30 of FIG. 3; and the output voltage of the photoelectric sensor 62 varies in an analog form. The output voltage of the photoelectric sensor 62 is applied to the input terminal 192 of the trigger circuit 194; and at an input voltage, to the input terminal 192, as selectively chosen by adjustment of the potentiometer 198 and the resultant bias voltage that is applied to the bias terminal 196, the output of the trigger circuit 194 at the Q output terminal 200 changes digitally from 0 to 1 or from 1 to 0, depending upon whether the input voltage at the terminal 192 is increasing or decreasing, and depending upon the internal connections in the trigger circuit 194.

When the contact actuator 42 extends to the position wherein the pressure actuated switch 102 of FIG. 1 is actuated by the contactor 32 contacting the container 74 and applying force thereto, or when the mechanically actuated switch 124 of FIG. 8 indicates that the actuator 42 is fully extended, a digital signal is applied to the clock terminal 208*a* of the flip-flop circuit 204*a* by the conduit 164*b*; and a digital signal is applied to the function box 150*a* by the conduit 164*a* to retract the contact actuator 42. Thus, at the time that the mechanical contactor 32 is firmly pressed against the container 74, a digital signal is applied to the clock terminal 208*a*; and at this instant, whatever digital signal is applied to the input terminal 206*a* is then developed in the Q output terminal 210*a*. Therefore, the flip-flop circuit 204*a* is effective to determine the instant at which the digitalized output of the photoelectric sensor 62 is read.

At this same time, the contact actuator 42 is starting to retract; but the retraction of the contact actuator 42 is extremely slow in comparison with the high speed operation of the flip-flop circuit 204*a*. Then, when the contact actuator 42 is fully retracted, the mechanically actuated switch 104 of FIG. 2 produces a digital signal in the conduits 166*a* and 166*b*. This digital signal in the conduit 166*a* is supplied to the input gate 216*a* of the AND gate 214; and the digitalized signal in the conduit 166*b* is applied to the clock terminal 208*b* of the flip-flop circuit 204*b*, thereby transferring the digital signal in the terminals 210*a* and 206*b* to the Q output terminal 210*b* at the time that the contact actuator 42 is fully retracted.

Then, when the container 74 is transferred from the position 138 to the position 140 of FIG. 1, and a new container (not shown) is positioned at the position 138, a new digital signal is produced in the conduit 164*b* by either the switch 102 of FIG. 1 or the switch 124 of FIG. 8 so that a digital signal in the output terminal 210*b* and the input terminal 206*c* is transferred to the Q output terminal 210*c*.

Returning now to consider the direction of change of the output signals, if a decrease in transmission of light from the light source 60 to the photoelectric sensor 62 indicates a container 74 that is out of either the minimum or maximum size limitation, and if the corresponding decrease in voltage at the input terminal 192 of the trigger circuit 194 results in a change in the voltage in the output terminal 200 from 1 to 0, then 0 is the reject signal.

The 0 reject signal is transferred to the Q output terminal 210*a* of the flip-flop circuit 204*a* at the instant that a digital signal in the clock terminal 208*a* indicates that the mechanical contactor 32 is firmly pressed against the container 74; the 0 reject signal is transferred to the Q output terminal 210*b* of the flip-flop circuit 204*b* at the instant that a digital signal in the clock terminal 208*b* indicates that the contact actuator 42 is fully retracted; and the 0 reject signal is transferred to the Q output terminal 210*c* of the flip-flop circuit 204*c* at the instant that a digital signal in the clock terminal 208*c* indicates that the mechanical contactor 32 is now firmly pressed against another container (not shown) that is immediately upstream of the container 74 and that is now at the position 138 of FIG. 1.

At this time, if the container 74 is outside either the minimum or maximum size limitation, there is a 1 reject signal in the $\overline{Q}$ output terminal 212*c* that corresponds to the 0 reject signal in the Q output terminal 210*c*.

The 1 reject signal is connected to the function box 168 by the conduit 176; so that the ejector actuator 54 extends to eject the container 74 and then retracts, as previously described. At the completion of retraction of the ejector actuator 54, a digital signal in the conduit 180 cooperates with a digital signal in the conduit 166*a*, showing that both actuators 42 and 54 are retracted, and actuating the AND gate 214 to start the conveyor 12.

If it is not deemed necessary to stop the conveyor 12 for the inspection operation, the circuit of FIG. 9 is modified by eliminating the function boxes 150 and 152 and the AND gate 214.

Referring again to FIGS. 1–6, adjustment of the optical gauging device 26 is achieved by adjusting the handle 20 and/or the handle 36 to provide an equal reduction in the transmission of light at both of the size limitations and then to adjust the potentiometer 108 to provide a bias voltage to the bias terminal 196 of the trigger circuit 194 that will cause the trigger circuit to trigger at a voltage input that corresponds to the reduction in transmitted light at the minimum and maximum size limitations.

In summary, the inspection device 10 includes mechanical reference means 34 for contacting the containers 74 at a first selected location 100; mechanical contactor means 32 for contacting the container 74 at a second selected location 98 and for gauging the container 74; light beam detector means 28, comprising a light source 60 and a photoelectric sensor 62, for supplying light to the photoelectric sensor 62, for sensing light received by the photoelectric sensor 62, and for controlling a first signal at the Q output terminal 200 of the trigger circuit 194 in response to the light received by the photoelectric sensor 62; transducer means 30 that includes a first member 56 and a second member 58, being optically interposed between the light source 60 and the photoelectric sensor 62 and being operatively connected to the mechanical contactor means 32 by an arm 90, for transmitting the light to the photoelectric sensor 62 and for varying the transmission of light to the photoelectric sensor 62 in accordance with the gauging of the container 74 and in accordance with both of the size limitations thereof as determined by variations in optical overlapping of the aperture 70 of the first member 56 and the aperture 72 of the second member 58, whereby the first signal indicates whether or not the one container 74 is outside either of the size limitations.

The inspection device 10 further includes conveyor means 12 for conveying the containers 74 sequentially between the mechanical reference means 34 and the mechanical contactor means 32; container position detector means 46 that includes a light source 48 and a photoelectric sensor 50, for controlling a second signal at the Q output terminal 188 of the trigger circuit 184 that indicates the position of the container 74 and subsequent containers (not shown) relative to a line or position 138 between the mechanical reference means 34 and the mechanical contactor means 32 as the containers 74 are conveyed therebetween; contactor actuator means 42, being operatively connected to the mechanical contactor means 32 and to the container position detector means 46, for actuating the mechanical contactor means 32 into contact with the one container 74 in response to the second signal that is provided at the Q output terminal 188 by the trigger circuit 184; contact detector means that comprises either a pressure actuated switch 102 or a mechanically actuated switch 124 being operatively connected to the mechanical contactor means 32 by a connection to the contact actuator 42, for controlling a third signal in the conduits **164*a* and 164*b* that is indicative of the contacting of the mechanical reference means 34 and the mechanical contactor means 32 with the container 74; logic means that comprises a flip-flop circuit 204*a*, being operatively connected to both the light beam detector means 28 via the trigger circuit 194 and to the contact detector means (switch 102 or switch 124) via the conduit 164*b*, for controlling a fourth or reject signal at the Q output terminal 210*a* of the flip-flop circuit 204*a* to be a function of the first signal in the terminal 200 when the third signal in the conduit 164*b* indicates that the mechanical reference means 34 and the mechanical contactor means 32 are in contact with the one container 74; ejector means 52, being disposed downstream of the mechanical reference means 34 and the mechanical contactor means 32 with respect to the sequential conveying of containers 74 from a line or position 138 to a line or position 140, for ejecting rejected ones of the containers 74 from the conveyor 12; and memory means that comprises flip-flop circuits 204*b* and 204*c*, being operatively connected to the logic means of the flip-flop circuit 204*a*, for receiving the reject signal from the Q output terminal 210*a* of the flip-flop circuit 204*a*, and for delaying transmission of the reject signal to the ejector means 52 until the container 74 has been conveyed downstream to the ejector means 52 by delaying transmission of the reject signal from the Q output terminal 210*a* of the flip-flop circuit 204*a* to the Q output terminal 210*b* of the flip-flop circuit 204*b* until the contact actuator 42 is fully retracted, and by further delaying the transmission of the reject signal from the Q output terminal 210*b* of the flip-flop circuit 204*b* to the Q output terminal 210*c* of the flip-flop circuit 204*c* until the contact actuator 42** is fully extended the second time.

While there have been described above the principles of the present invention in connection with specific apparatus, it is to be clearly understood that the description is made only by way of example; and the scope of the invention is to be defined by the appended claims.

Industrial Applicability

The present invention is industrially applicable to either individual manual inspection or automatic conveyor line inspection of articles, and it is more particularly applicable to inspection of containers, such as glass bottles, that include a concave side panel.

What is claimed is:

1. An inspection device for detecting containers that are outside of minimum or maximum size limitations, said containers including a concave side panel, which device comprises:

mechanical reference means for contacting one of said containers at a first selected location;

mechanical contactor means for contacting said one container at a second selected location on said concave side panel and for gauging said one container;

light beam detector means, comprising a light source and a photoelectric sensor, for supplying light to said photoelectric sensor, for sensing light received by said photoelectric sensor, and for controlling a first signal in response to said light received by said photoelectric sensor; and transducer means, being optically interposed between said light source and said photoelectric sensor and being operatively connected to said mechanical contactor means, for transmitting said light to said photoelectric sensor and for varying said transmission of light to said photoelectric sensor in accordance with said gauging of said one container and in accordance with both of said size limitations thereof, whereby said first signal indicates whether or not said one container is outside either of said size limitations;

conveyor means for conveying said containers sequentially between said mechanical reference means and said mechanical contactor means;

container position detector means, for controlling a second signal that indicates the position of said one container and subsequent containers relative to a line between said mechanical reference means and said mechanical contactor means as said containers are conveyed therebetween;

contactor actuator means, being operatively connected to said mechanical contactor means and to said container position detector means, for actuating said mechanical contactor means into said contact with said one container in response to said second signal, and for actuating said mechanical contactor means away from said contact without stopping said conveying of containers;

contact detector means, being operatively connected to said mechanical contactor means, for controlling a third signal that is indicative of said contacting of said mechanical reference means and said mechanical contactor means with said one container; and logic means, being operatively connected to both said light beam detector means and to said contact detector means, for controlling a fourth or reject signal to be a function of said first signal when said third signal indicates that said mechanical reference means and said mechanical contactor means are in contact with said one container.

2. An inspection device as claimed in claim 1 in which said transducer means comprises a first member having a first light transmitting portion and a second member having a second light transmitting portion;

said operative connection of said transducer means to said mechanical contactor means comprises operatively connecting one of said members to said mechanical contactor means; and said transmitting of light and said varying of transmission of light comprise optically overlapping said light transmitting portions and varying of said optical overlapping.

3. An inspection device for detecting containers that are outside of maximum or minimum size limitations, said containers including a concave side panel, which device comprises:

mechanical reference means for contacting one of said containers at a first selected location;

mechanical contactor means for contacting said one container at a second selected location on said concave side panel and for gauging said one container;

light beam detector means, comprising a light source and a photoelectric sensor, for supplying light to said photoelectric sensor, for sensing light received by said photoelectric sensor, and for controlling a first signal in response to said light received by said photoelectric sensor;

transducer means, being optically interposed between said light source and said photoelectric sensor and being operatively connected to said mechanical contactor means, for transmitting said light to said photoelectric sensor and for varying said transmission of light to said photoelectric sensor in accordance with said gauging of said one container and in accordance with both of said size limitations thereof, whereby said first signal indicates whether or not said one container is outside either of said size limitations;

conveyor means for conveying said containers sequentially between said mechanical reference means and said mechanical contactor means;

container position detector means, for controlling a second signal that indicates the position of said one container and subsequent containers relative to a line between said mechanical reference means and said mechanical contactor means as said containers are conveyed therebetween;

contact detector means, being operatively connected to said mechanical contactor means, for controlling a third signal that is indicative of said contacting of said mechanical reference means and said mechanical contactor means with said one container;

contactor actuator means, being operatively connected to said mechanical contactor means and to said container position detector means, for actuating said mechanical contactor means into said contact with said one container in response to said second signal and for actuating said mechanical contactor means away from said contact in response to said third signal without stopping said conveying of containers;

logic means, being operatively connected to both said light beam detector means and to said contact detector means, for controlling a fourth or reject signal to be a function of said first signal when said third signal indicates that said mechanical reference means and said mechanical contactor means are in contact with said one container;

ejector means, being disposed downstream of said mechanical reference means and said mechanical contactor means with respect to said sequential conveying of said containers, for ejecting rejected ones of said containers from said conveyor; and memory means, being operatively connected to said logic means and to said ejector means, for receiving said reject signal, and for delaying transmission of said reject signal to said ejector means until said one container has been conveyed downstream to said ejector means.

4. An inspection device as claimed in claim 3 in which said transducer means comprises a first member having a first light transmitting portion and a second member having a second light transmitting portion;

said operative connection of said transducer means to said mechanical contactor means comprises operatively connecting one of said members to said mechanical contactor means; and said transmitting of light and said varying of transmission of light comprise optically overlapping said light transmitting portions and varying of said optical overlapping.

* * * * *